US010176711B2

(12) United States Patent
Kelly et al.

(10) Patent No.: US 10,176,711 B2
(45) Date of Patent: Jan. 8, 2019

(54) ANALYZING BIG DATA TO MANAGE TRAFFIC FLOW

(71) Applicant: Verizon Patent and Licensing Inc., Arlington, VA (US)

(72) Inventors: Susan Kelly, Maynard, MA (US); Jian Huang, Sudbury, MA (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 0 days.

(21) Appl. No.: 15/497,308

(22) Filed: Apr. 26, 2017

(65) Prior Publication Data

US 2018/0315306 A1 Nov. 1, 2018

(51) Int. Cl.
*G08G 1/083* (2006.01)

(52) U.S. Cl.
CPC ..... *G08G 1/083* (2013.01)

(58) Field of Classification Search
CPC ..... G01P 11/00; G01P 11/02; G08G 1/00; G08G 1/01; G08G 1/0104; G08G 1/0125; G08G 1/0129; G08G 1/0133; G08G 1/0145; G08G 1/065; G08G 1/07; G08G 1/08; G08G 1/081; G08G 1/082; G08G 1/083; G08G 1/09; G08G 1/095; G08G 1/017; G05B 2219/35034; H04L 41/50; H04L 41/5061; H04L 41/5064; H04L 41/5067; Y04S 50/00; Y04S 50/01; G06Q 30/02; G06Q 30/0202
USPC ..... 340/907–932
See application file for complete search history.

(56) References Cited

U.S. PATENT DOCUMENTS

2009/0322561 A1* 12/2009 Morioka ..... G08G 1/08 340/907
2011/0205086 A1* 8/2011 Lamprecht ..... G08G 1/08 340/928

* cited by examiner

*Primary Examiner* — Brian Wilson

(57) ABSTRACT

A device can determine a set of average vehicle entry rates using traffic data associated with an intersection and can determine a set of average vehicle wait time values. The device can generate one or more data structures that include a set of state values that include the set of average vehicle entry rates and a set of transition values. The device can determine a set of customer satisfaction rating values. The device can generate a prediction data structure that associates the set of state values with a set of traffic light cycle time values and one or more customer satisfaction rating values. The device can determine a current state value. The device can identify a state value and a traffic light cycle time value that is associated with a highest customer satisfaction rating. The device can provide the traffic light cycle time value to a traffic controller.

20 Claims, 9 Drawing Sheets

100

State Transition Data Structure 1

| State 1 | State 2 | State 3 | ... | State N |
|---|---|---|---|---|
| $\lambda_1, \lambda_2$ | .1, .1 | .1, .2 | ... | 10, 10 |
| .1, .1 | 16% | 9% | ... | 0% |
| .1, .1 | 9% | 16% | ... | 0% |
| .1, .2 | 0% | 0% | ... | 0% |
| ... | ... | ... | ... | ... |
| 10,10 | 0% | 0% | ... | 16% |

MDP

State Transition Data Structure 2
(one per action)

| State 1 | State 2 | State 3 | ... | State N |
|---|---|---|---|---|
| $\lambda_1, \lambda_2, r$ | .1, .1, 30 | .1, .2, 30 | ... | 10, 10, 300 |
| .1, .1, 20 | 16% | 9% | ... | 0% |
| .1, .1, 10 | 9% | 16% | ... | 0% |
| .1, .2, 20 | 0% | 0% | ... | 0% |
| ... | ... | ... | ... | ... |
| 10,10, 300 | 0% | 0% | ... | 16% |

MDP

125
Generate, as part of the MDP, one or more state transition data structures

Traffic Management Platform

| $\lambda_1,\lambda_2,r$ State | Vi(s) Satisfaction Rating | a Green Light Time |
|---|---|---|
| .1, .1, 10 | 2.8 | 10 sec |
| .1, .1, 20 | 2.4 | 10 sec |
| .1, .2, 10 | 1.5 | 20 sec |
| ••• | ••• | ••• |
| 10,10, 300 | 1.0 | 300 sec |

ANALYZING BIG DATA TO MANAGE TRAFFIC FLOW

BACKGROUND

Traffic lights can manage traffic flow by controlling an amount of time to allow traffic to pass through an intersection. However, intersections can become congested for a number of reasons, such as heavy traffic, an accident, construction, or the like.

DETAILED DESCRIPTION OF PREFERRED EMBODIMENTS

The following detailed description of example implementations refers to the accompanying drawings. The same reference numbers in different drawings can identify the same or similar elements.

Traffic at an intersection can be unpredictable due to heavy traffic, an accident, construction, or the like. In some cases, poor traffic conditions can disrupt vehicle throughput at the intersection, causing a disproportionate number of vehicles to stop in one direction of the intersection. The unpredictable events can make it difficult for a traffic light controller to balance the flow of traffic at the intersection.

Implementations described herein provide for a traffic management platform that analyzes traffic data and utilizes a Markov decision process (MDP) to predict traffic flow at an intersection. Additionally, the traffic management platform can recommend a traffic light cycle time that reduces vehicle wait time, thereby improving vehicle throughput at the intersection. By predicting traffic flow using an MDP, the traffic management platform conserves processing resources relative to predicting traffic flow using a standard machine learning technique (e.g., a technique that uses historical data to train a model).

FIGS. 1A-1F are diagrams of an overview of an example implementation 100 described herein. As shown in FIGS. 1A-1F, example implementation 100 shows a traffic management platform that utilizes an MDP to predict traffic flow at an intersection. Additionally, the traffic management platform can recommend, to a traffic controller, a traffic light cycle time to improve vehicle throughput at an intersection.

Figure 1A:
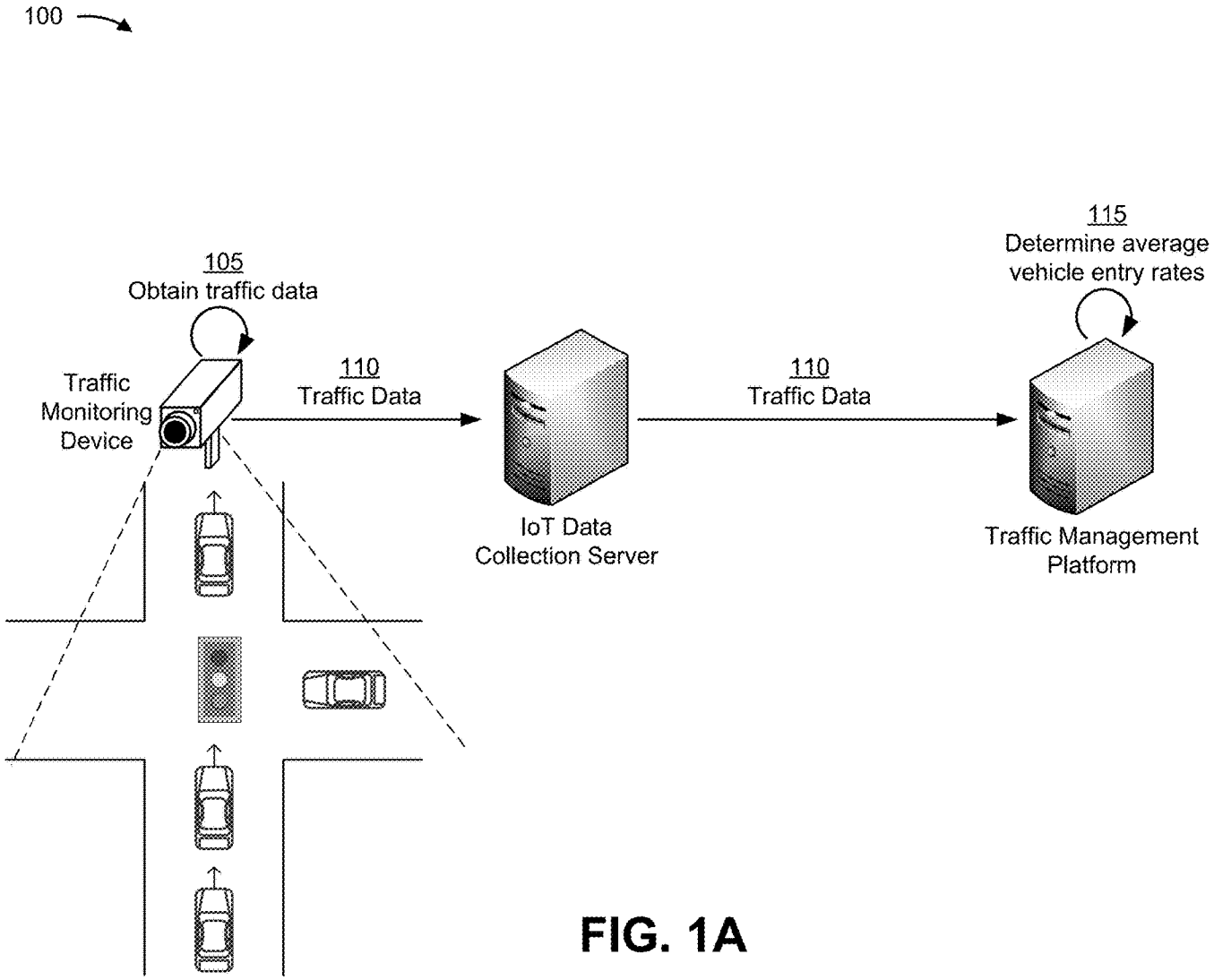
FIGS. 1A-1F are diagrams of an overview of an example implementation described herein.

As shown in FIG. 1A, and by reference number 105, a traffic monitoring device (e.g., a camera, an internet of things (IoT) device, a detector associated with IoT devices, a radio frequency identifier (RFID) detector, etc.) can monitor the intersection to obtain traffic data. Traffic data can include vehicle information, such as a vehicle identifier, information indicating a vehicle speed, information indicating a vehicle location, time information (e.g., a time stamp associated with a vehicle entering the intersection), and/or the like. Additionally, traffic data can include intersection information, such as information indicating a geographic point of interest, information indicating traffic light cycle times, and/or the like.

As shown by reference number 110, the traffic monitoring device can transmit the traffic data to an IoT data collection server, which can transmit the traffic data to the traffic management platform. For example, the traffic monitoring device can periodically transmit the traffic data (e.g., every minute, every hour, etc.) to the IoT data collection server during a baseline time period (e.g., every month, every three months, etc.), and the IoT data collection server can periodically transmit the traffic data to the traffic management platform. In some implementations, the traffic management platform can store the traffic data based on time intervals. For example, if a time interval is between 7:00:00 AM and 7:00:30 AM, the traffic management platform can store all traffic data associated with vehicles that pass through the intersection between 7:00:00 AM and 7:00:30 AM.

As shown by reference number 115, the traffic management platform can determine a set of average vehicle entry rates. For example, the traffic management platform can analyze the traffic data to determine a set of average vehicle entry rates. An average vehicle entry rate can identify an average rate at which vehicles enter the intersection during a time interval.

By using traffic data to determine average vehicle entry rates for the intersection, the traffic management platform can use the average vehicle entry rates to generate an MDP to predict traffic flow at the intersection.

As shown in FIGS. 1B-1E, the traffic management platform can generate and implement an MDP to predict traffic flow at the intersection. For example, the MDP can define states, actions, transition probabilities, and customer satisfaction ratings, and can be used to predict traffic flow at the intersection. A state can include one or more parameters that define characteristics of the intersection for a particular time interval. For example, a state can be represented by one or more state parameters, such as by an average vehicle entry rate for a first direction (e.g., north-south), an average vehicle entry rate for a second direction (e.g., east-west), a traffic light cycle time associated with the first direction and/or the second direction, and/or the like. An action can be a recommendation that the traffic management platform can provide to a traffic controller, such as a recommendation of a traffic light cycle time for a particular direction (i.e., a time in which a traffic light can remain red or green). A transition probability can indicate a likelihood of transitioning from a first state to a second state. A customer satisfaction rating can be a metric used to select actions that improve vehicle throughput at the intersection. For example, a customer satisfaction rating can be associated with an average vehicle wait time (e.g., an average time that a vehicle waits at the intersection during a time interval), where a lower vehicle wait time is associated with a higher customer satisfaction rating and a higher vehicle wait time is associated with a lower customer satisfaction rating.

Figure 1B:
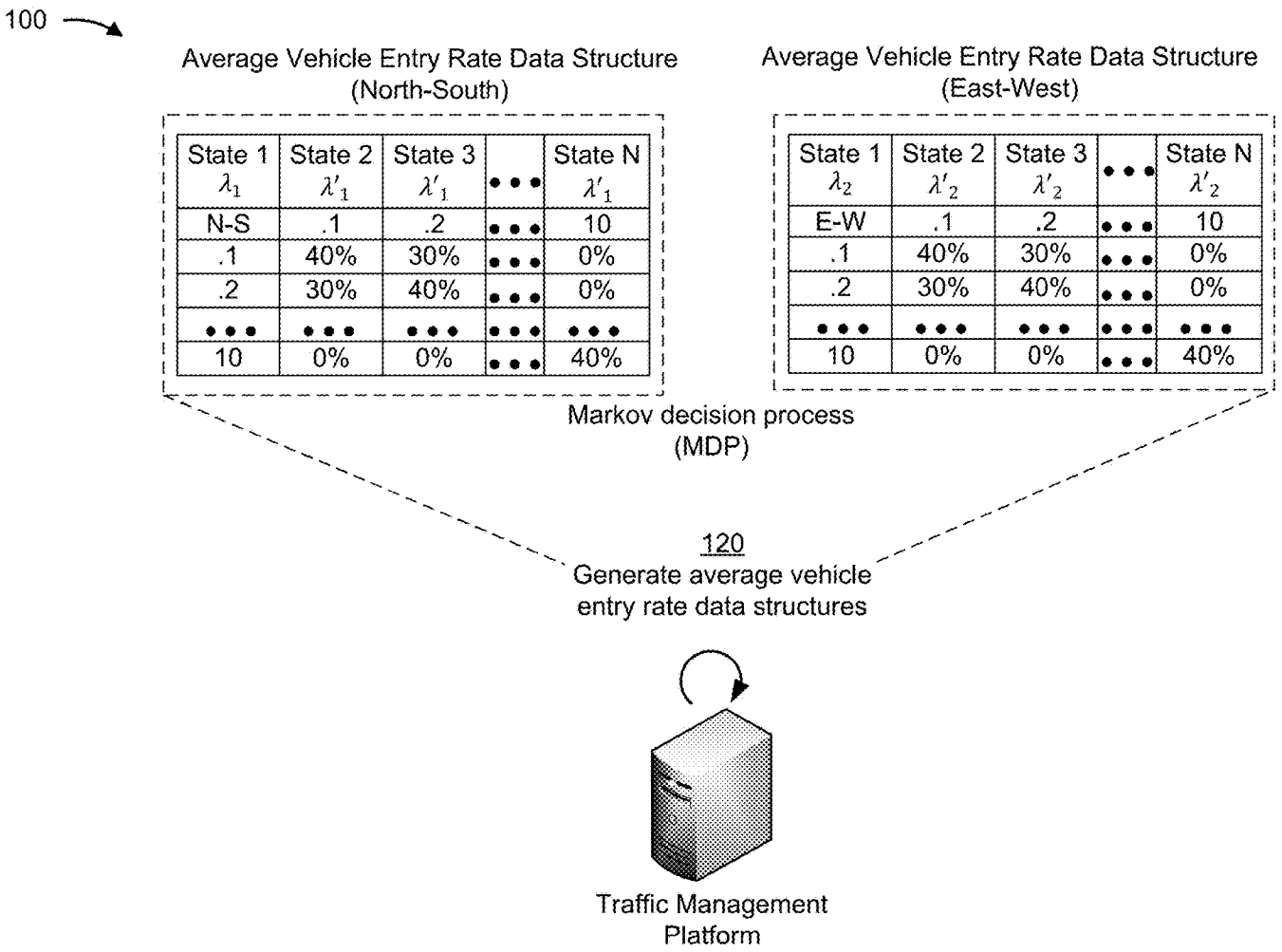

As shown in FIG. 1B, and by reference number 120, the traffic management platform can generate average vehicle entry rate data structures as part of the MDP. For example, the traffic management platform can generate a first average vehicle entry rate data structure associated with a first direction (shown as north-south) and a second average vehicle entry rate data structure associated with a second direction (shown as east-west).

As shown by the first average vehicle entry rate data structure, the traffic management platform can associate average vehicle entry rates of a first state (shown as state 1)

and average vehicle entry rates of a second state (shown as states 2 through N) via a set of probabilities indicating a likelihood of transitioning from the first state to the second state. The first state can be associated with a first time interval and the second state can be associated with a second time interval.

As an example, assume the traffic management platform determines an average vehicle entry rate for a first time interval (e.g., $\lambda_1=0.1$), meaning that an average of 0.1 vehicles enter the intersection during the first time interval. Additionally, the traffic management platform can determine average vehicle entry rates for a second time interval (e.g., $\lambda'_1=0.1$, $\lambda'_1=0.2$, . . . , $\lambda'_1=10$). In this case, the traffic management platform can determine a set of probabilities indicating a likelihood of transitioning from the average vehicle entry rate associated with the first time interval to the average vehicle entry rates associated with the second time interval. For example, if there are ten possible average vehicle entry rate values associated with the second time interval, and four of the values are 0.1, then the probability of transitioning to an average vehicle entry rate of 0.1 is 40%.

By generating data structures that include probabilities indicating a likelihood of transitioning between average vehicle entry rates, the traffic management platform establishes a framework that can be used to predict traffic flow.

Figure 1C:
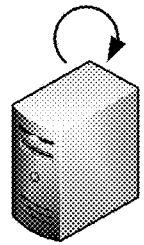

As shown in FIG. 1C, and by reference number 125, the traffic management platform can, as part of the MDP, generate one or more state transition data structures. For example, the traffic management platform can generate one or more state transition data structures that include a set of probabilities indicating a likelihood of transitioning between states. In some cases, the traffic management platform can determine transition probabilities by multiplying values included in an average vehicle entry rate data structure associated with a first direction and values included in an average vehicle entry rate data structure associated with a second direction. Additionally, or alternatively, the traffic management platform can generate one or more state transition data structures that associate average vehicle entry rates and traffic light cycle times (e.g., red light and/or green light times for each direction of the intersection).

As shown by state transition data structure one, the traffic management platform can generate a state transition data structure that stores average vehicle entry rates for a first direction and average vehicle entry rates for a second direction (e.g., $\lambda_1$ can represent north-south and $\lambda_2$ can represent east-west). In this case, the traffic management platform can generate a state transition data structure that includes a set of probabilities indicating a likelihood of transitioning from a first state (shown as state 1) to a second state (shown as state 2 through state N).

As an example, the traffic management platform can determine a likelihood of transitioning from the first state to the second state by multiplying the values included in the first average vehicle entry rate data structure by the values included in the second average vehicle entry rate data structure. In this case, the traffic management platform can multiply the first probability in the first average vehicle entry rate data structure (shown in FIG. 1B as 40%) by the first probability in the second average vehicle entry rate data structure (shown in FIG. 1B as 40%) to determine a probability of transitioning from the first state to the second state (shown in FIG. 1C as 16%). In this way, the traffic management platform can identify transition probabilities while considering both directions of the intersection.

Additionally, or alternatively, and as shown by state transition data structure two, the traffic management platform can generate a data structure that associates average vehicle entry rates with traffic light cycle times. For example, the traffic management platform can store an average vehicle entry rate for a first direction ($\lambda_1$), an average vehicle entry rate for a second direction ($\lambda_2$), and a red light time associated with the first direction (r). By storing average vehicle entry rates and traffic light cycle times together, the traffic management platform stores data in a format that allows for further processing, as described further herein.

Additionally, if the traffic light associated with the first direction is implementing a red light, then the traffic management platform can consider a set of actions (e.g., green light times) to recommend to a traffic controller to improve vehicle throughput at the intersection. In this case, the traffic management platform can generate state transition data structures for a set of actions. As an example, assume the traffic light has a maximum traffic light cycle time of 30 seconds. In this case, the traffic management platform can generate thirty state transition data structures (e.g., one per green light cycle time). This can allow the traffic management platform to consider the set of actions while determining the action most likely to improve vehicle throughput at the intersection.

In this way, the traffic management platform is able to generate state transition data structures that can be further analyzed to predict traffic flow, as described further herein.

Figure 1D:
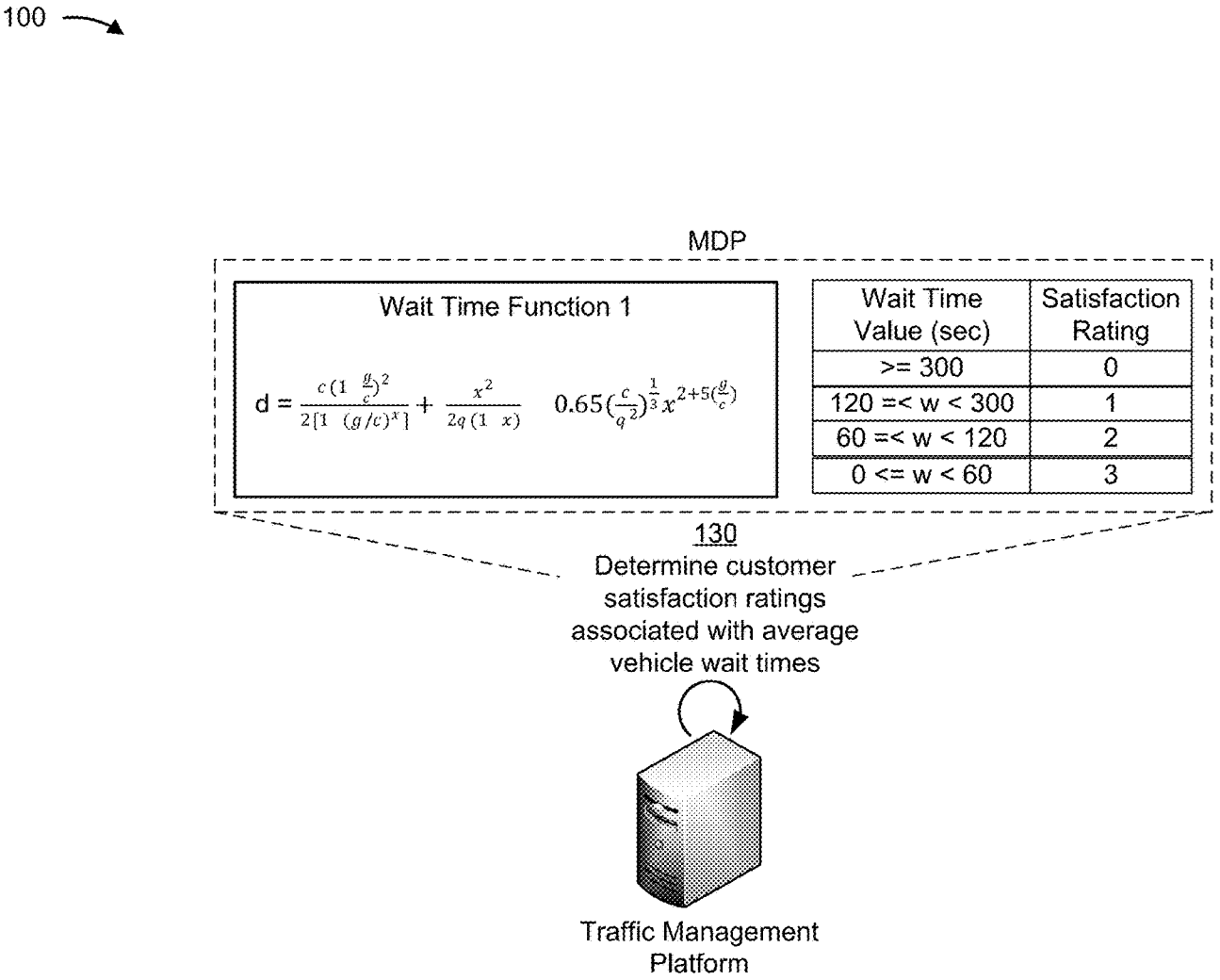

As shown in FIG. 1D, and by reference number 130, the traffic management platform can determine a set of customer satisfaction ratings associated with average vehicle wait times. For example, the traffic management platform can use a wait time function to analyze the one or more state transition data structures to determine a set of average vehicle wait time values for the set of states of the intersection. In this case, the traffic management platform can use the set of wait time values to determine a corresponding set of customer satisfaction rating values. In this way, the traffic management platform can associate states with customer satisfaction ratings, thereby allowing the traffic management platform to identify states with low average vehicle wait times (and high customer satisfaction ratings) as candidate states to recommend to the traffic controller.

Figure 1E:
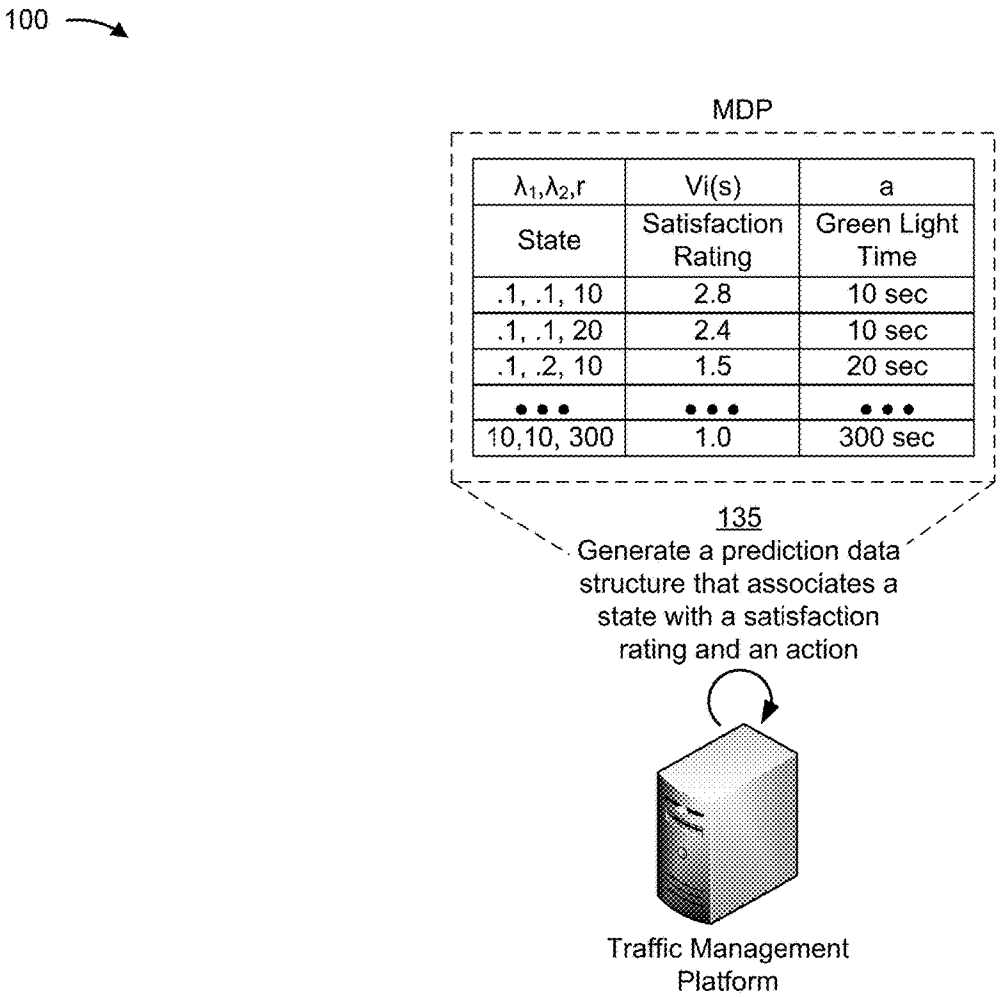

As shown in FIG. 1E, and by reference number 135, the traffic management platform can generate a prediction data structure that associates a state with green light time (e.g., a value indicating a duration at which the subsequent light will remain green) and a highest customer satisfaction rating. A highest customer satisfaction rating can refer to a customer satisfaction rating for a particular state that is higher than all other customer satisfaction ratings for that particular state. For example, the traffic management platform can store a state value with a traffic light cycle time value that is associated with a highest customer satisfaction rating. As an example, assume the traffic management platform determines customer satisfaction ratings for a state and all (or some) possible traffic light cycle times. In this case, the traffic management platform can store, with the state value, a traffic light cycle time value associated with a highest customer satisfaction rating for that state. In this way, the traffic management platform can use the prediction data structure to determine an action that can improve vehicle throughput at the intersection.

Figure 1F:
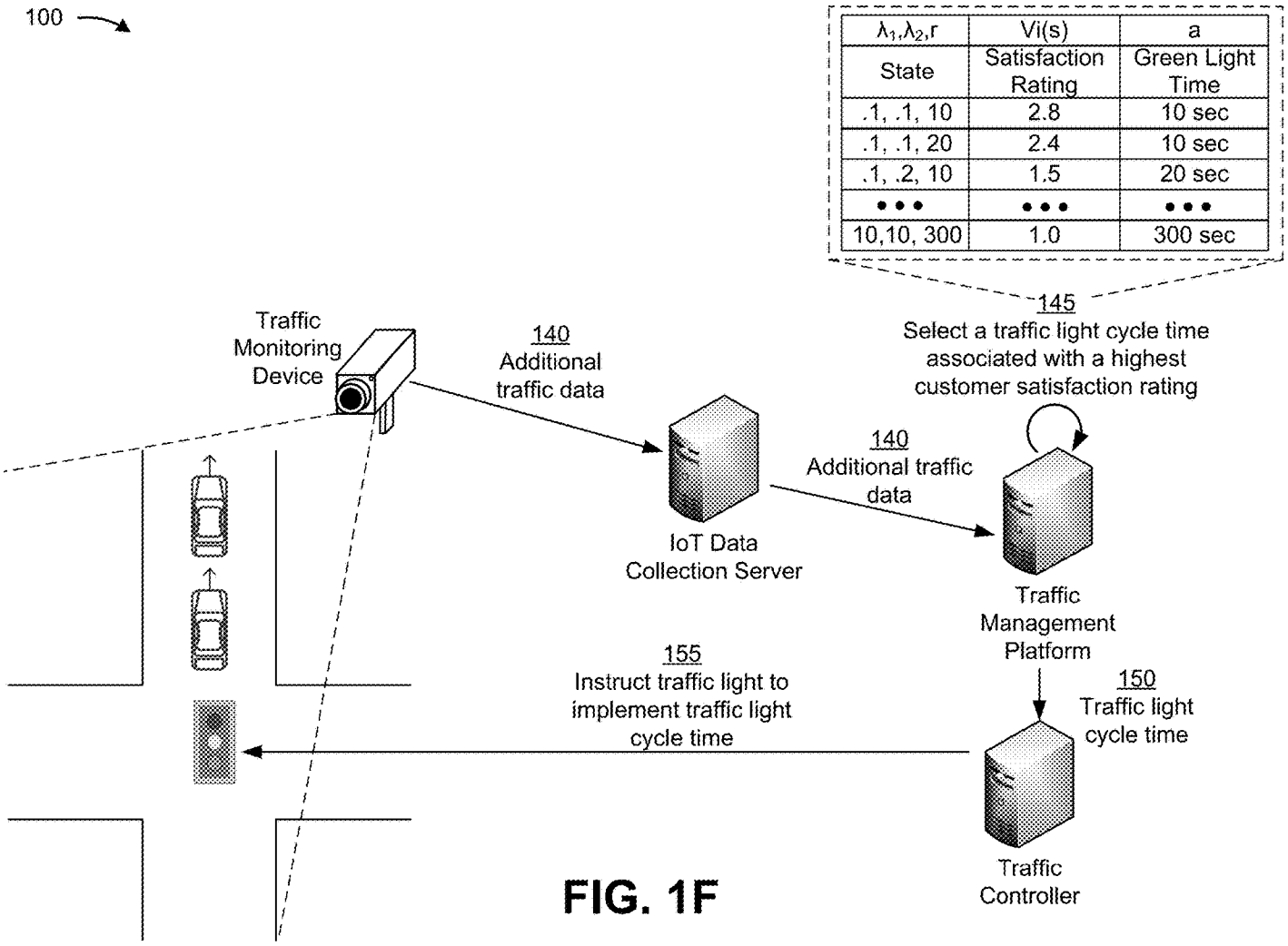

As shown in FIG. 1F, the traffic management platform can select a traffic light cycle time capable of improving vehicle throughput at the intersection. As shown by reference number 140, the traffic monitoring device can transmit, to the IoT data collection server, additional traffic data associated with a current state of the intersection. In this case, the IoT data collection server can transmit the additional traffic data to the traffic management device.

As shown by reference number 145, the traffic management platform can select a traffic light cycle time associated with a highest customer satisfaction rating. For example, the traffic management platform can determine a current state of the intersection, and can select a traffic light cycle time (e.g., shown as a green light time) associated with a highest customer satisfaction rating. In this case, the traffic management platform can determine a current state by determining a current average vehicle entry rate and a current traffic light cycle time. Additionally, the traffic management platform can compare the current state and the set of states included in the prediction data structure. In this case, the traffic management platform can identify a state that matches the current state or that satisfies a threshold level of similarity with the current state, and can select a traffic light cycle time associated with the selected state.

As shown by reference number 150, the traffic management platform can provide the traffic light cycle time value to a traffic controller. As shown by reference number 155, the traffic controller can instruct a traffic light to implement the traffic light cycle time. In this way, the traffic management platform uses MDP to predict traffic flow and to recommend a traffic light cycle time that can improve vehicle throughput at the intersection.

As indicated above, FIGS. 1A-1F are provided merely as an example. Other examples are possible and can differ from what was described with regard to FIGS. 1A-1F. For example, the traffic management platform can recommend a traffic light cycle time to improve vehicle throughput for different types of intersections, such as a two-way intersection as described in FIGS. 1A-1F, a three-way intersection, a four-way intersection, a roundabout, and/or the like.

Figure 2:
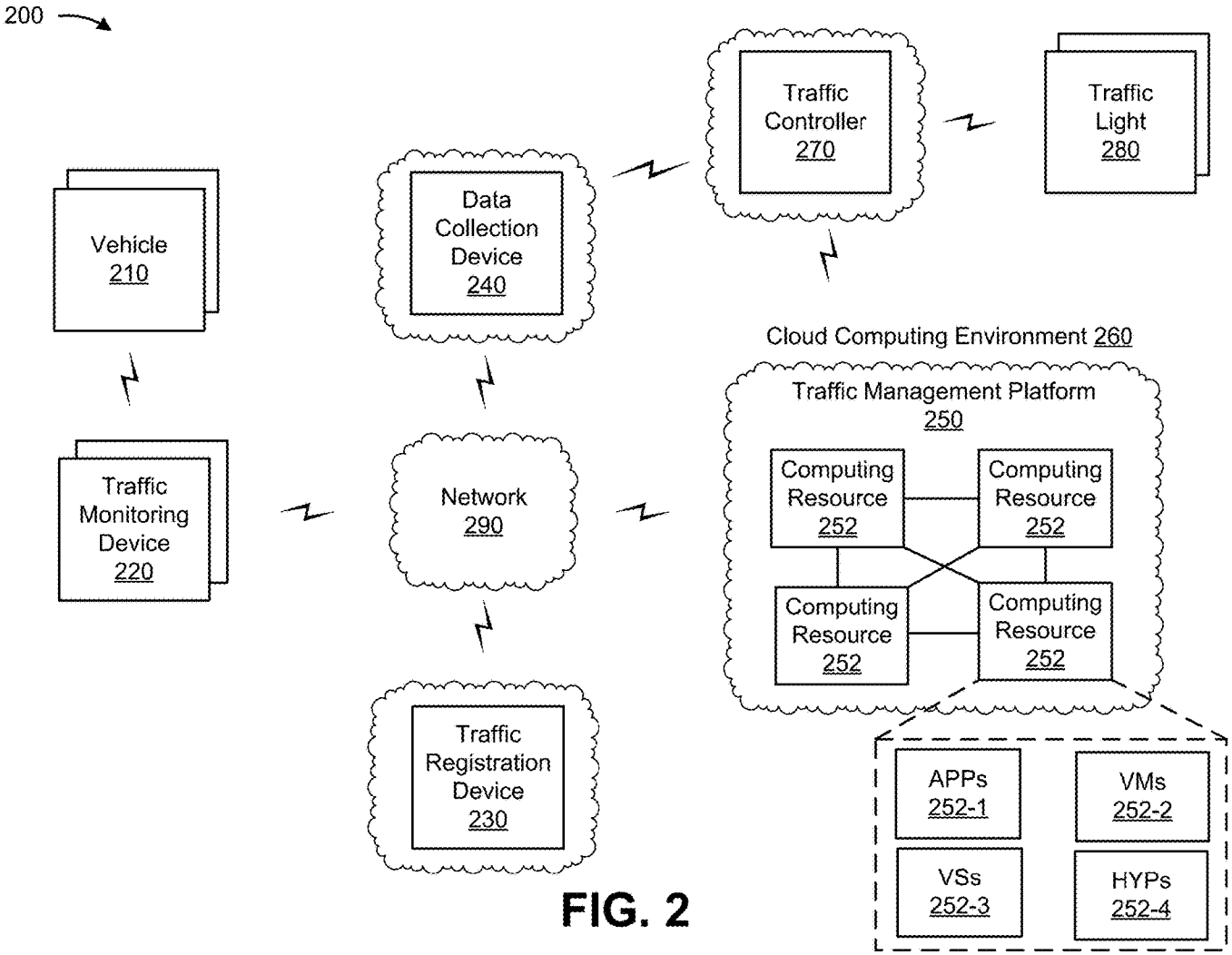
FIG. 2 is a diagram of an example environment in which systems and/or methods, described herein, can be implemented.

FIG. 2 is a diagram of an example environment 200 in which systems and/or methods, described herein, can be implemented. As shown in FIG. 2, environment 200 can include vehicle 210, traffic monitoring device 220, traffic registration device 230, data collection device 240, traffic management platform 250 hosted within cloud computing environment 260, traffic controller 270, traffic light 280, and/or network 290. Devices of environment 200 can interconnect via wired connections, wireless connections, or a combination of wired and wireless connections.

Vehicle 210 includes one or more vehicles capable of traveling through an intersection. For example, vehicle 210 can include a car, a truck, a bus, a motorcycle, and/or any other vehicle capable of traveling through the intersection.

Traffic monitoring device 220 includes one or more devices capable of obtaining, storing, and/or providing traffic data for an intersection. For example, traffic monitoring device 220 can include a sensor (e.g., a vehicle sensor, a sensor located at the intersection, etc.), a camera (e.g., a traffic camera, a vehicle camera, etc.), a device included within vehicle 210, such as a smart phone, a speed detecting device (e.g., a radar detector), and/or any other device capable of monitoring traffic data. In some cases, if there are no traffic monitoring device 220 available to monitor traffic data, a traffic counting cable can be implemented, such as an inductive loop capable of detecting the presence of a vehicle, a sensor capable of detecting weight, vehicle speed, axles, or vehicle length, a pneumatic tube counting device, or the like. In some implementations, traffic monitoring device 220 can monitor traffic associated with an intersection, and can provide the traffic data to data collection device 240.

Traffic registration device 230 includes one or more devices capable of registering traffic monitoring devices 220 to access data via a network (e.g., a telecommunication service provide network). For example, traffic registration device 230 can include a server or a group of servers. In some implementations, traffic monitoring device 220 can register with traffic registration device 230, allowing traffic monitoring device 220 to access the network for transmission of traffic data.

Data collection device 240 includes one or more devices capable of receiving, storing, processing, and/or providing traffic data. For example, data collection device 240 can include a server or a group of servers. In some implementations, data collection device 240 can be hosted in a cloud computing environment, such as a cloud computing environment that is independent of other components described herein, cloud computing environment 260, a cloud computing environment that hosts traffic controller 270, or the like.

Traffic management platform 250 includes one or more devices capable of receiving, storing, processing, and/or providing traffic data. For example, traffic management platform 250 can include a computing device, such as a server device (e.g., a host server, a web server, an application server, etc.), a data center device, or a similar device. In some implementations, traffic management platform 250 can obtain traffic data from data collection device 240. In some implementations, traffic management platform 250 can provide a traffic light cycle time to traffic controller 270.

In some implementations, as shown, traffic management platform 250 can be hosted in cloud computing environment 260. Notably, while implementations described herein describe traffic management platform 250 as being hosted in cloud computing environment 260, in some implementations, traffic management platform 250 might not be cloud-based (i.e., can be implemented outside of a cloud computing environment) or can be partially cloud-based.

Cloud computing environment 260 includes an environment that hosts traffic management platform 250. Cloud computing environment 260 can provide computation, software, data access, storage, and/or other services that do not require end-user knowledge of a physical location and configuration of system(s) and/or device(s) that host traffic management platform 250. As shown, cloud computing environment 260 can include a group of computing resources 252 (referred to collectively as "computing resources 252" and individually as "computing resource 252").

Computing resource 252 includes one or more personal computers, workstation computers, server devices, or another type of computation and/or communication device. In some implementations, computing resource 252 can host traffic management platform 250. The cloud resources can include compute instances executing in computing resource 252, storage devices provided in computing resource 252, data transfer devices provided by computing resource 252, etc. In some implementations, computing resource 252 can communicate with other computing resources 252 via wired connections, wireless connections, or a combination of wired and wireless connections.

As further shown in FIG. 2, computing resource 252 includes a group of cloud resources, such as one or more applications ("APPs") 252-1, one or more virtual machines ("VMs") 252-2, virtualized storage ("VSs") 252-3, one or more hypervisors ("HYPs") 252-4, or the like.

Application 252-1 includes one or more software applications that can be provided to or accessed by data collection device 240 and/or traffic controller 270. Application 252-1 can eliminate a need to install and execute the software applications on data collection device 240 and/or traffic controller 270. For example, application 252-1 can include software associated with traffic management platform 250 and/or any other software capable of being provided via cloud computing environment 260. In some implementations, one application 252-1 can send/receive information to/from one or more other applications 252-1, via virtual machine 252-2.

Virtual machine 252-2 includes a software implementation of a machine (e.g., a computer) that executes programs like a physical machine. Virtual machine 252-2 can be either a system virtual machine or a process virtual machine, depending upon use and degree of correspondence to any real machine by virtual machine 252-2. A system virtual machine can provide a complete system platform that supports execution of a complete operating system ("OS"). A process virtual machine can execute a single program, and can support a single process. In some implementations, virtual machine 252-2 can manage infrastructure of cloud computing environment 260, such as data management, synchronization, or long-duration data transfers.

Virtualized storage 252-3 includes one or more storage systems and/or one or more devices that use virtualization techniques within the storage systems or devices of computing resource 252. In some implementations, within the context of a storage system, types of virtualizations can include block virtualization and file virtualization. Block virtualization can refer to abstraction (or separation) of logical storage from physical storage so that the storage system can be accessed without regard to physical storage or heterogeneous structure. The separation can permit administrators of the storage system flexibility in how the administrators manage storage for end users. File virtualization can eliminate dependencies between data accessed at a file level and a location where files are physically stored. This can enable optimization of storage use, server consolidation, and/or performance of non-disruptive file migrations.

Hypervisor 252-4 can provide hardware virtualization techniques that allow multiple operating systems (e.g., "guest operating systems") to execute concurrently on a host computer, such as computing resource 252. Hypervisor 252-4 can present a virtual operating platform to the guest operating systems, and can manage the execution of the guest operating systems. Multiple instances of a variety of operating systems can share virtualized hardware resources.

Traffic controller 270 includes one or more devices capable of receiving, storing, processing, and/or providing an instruction associated with a traffic light cycle time. For example, traffic controller 270 can include a server of a group of servers. In some implementations, traffic controller 270 can receive, from traffic management platform 250, an instruction associated with a traffic light cycle time, and traffic controller 270 can provide the instruction to traffic light 280.

Traffic light 280 includes one or more devices capable of receiving, storing, and/or implementing an instruction associated with a traffic light cycle time. For example, traffic light 280 can include a device that supports a set of lights (e.g., a set of light emitting diodes (LEDs)) that can be used to indicate a particular traffic signal. In some implementations, traffic light 280 can implement an instruction associated with a traffic light cycle time that is received from traffic controller 270. In some implementations, traffic light 280 may include a traffic control device of a different type, such as a gate.

Network 290 includes one or more wired and/or wireless networks. For example, network 290 can include a cellular network (e.g., a fifth generation (5G) network, a fourth generation (4G) network, such as a long-term evolution (LTE) network, a third generation (3G) network, a code division multiple access (CDMA) network, another type of advanced generated network, etc.), a public land mobile network (PLMN), a local area network (LAN), a wide area network (WAN), a metropolitan area network (MAN), a telephone network (e.g., the Public Switched Telephone Network (PSTN)), a private network, an ad hoc network, an intranet, the Internet, a fiber optic-based network, a cloud computing network, or the like, and/or a combination of these or other types of networks.

The number and arrangement of devices and networks shown in FIG. 2 are provided as an example. In practice, there can be additional devices and/or networks, fewer devices and/or networks, different devices and/or networks, or differently arranged devices and/or networks than those shown in FIG. 2. Furthermore, two or more devices shown in FIG. 2 can be implemented within a single device, or a single device shown in FIG. 2 can be implemented as multiple, distributed devices. Additionally, or alternatively, a set of devices (e.g., one or more devices) of environment 200 can perform one or more functions described as being performed by another set of devices of environment 200.

Figure 3:
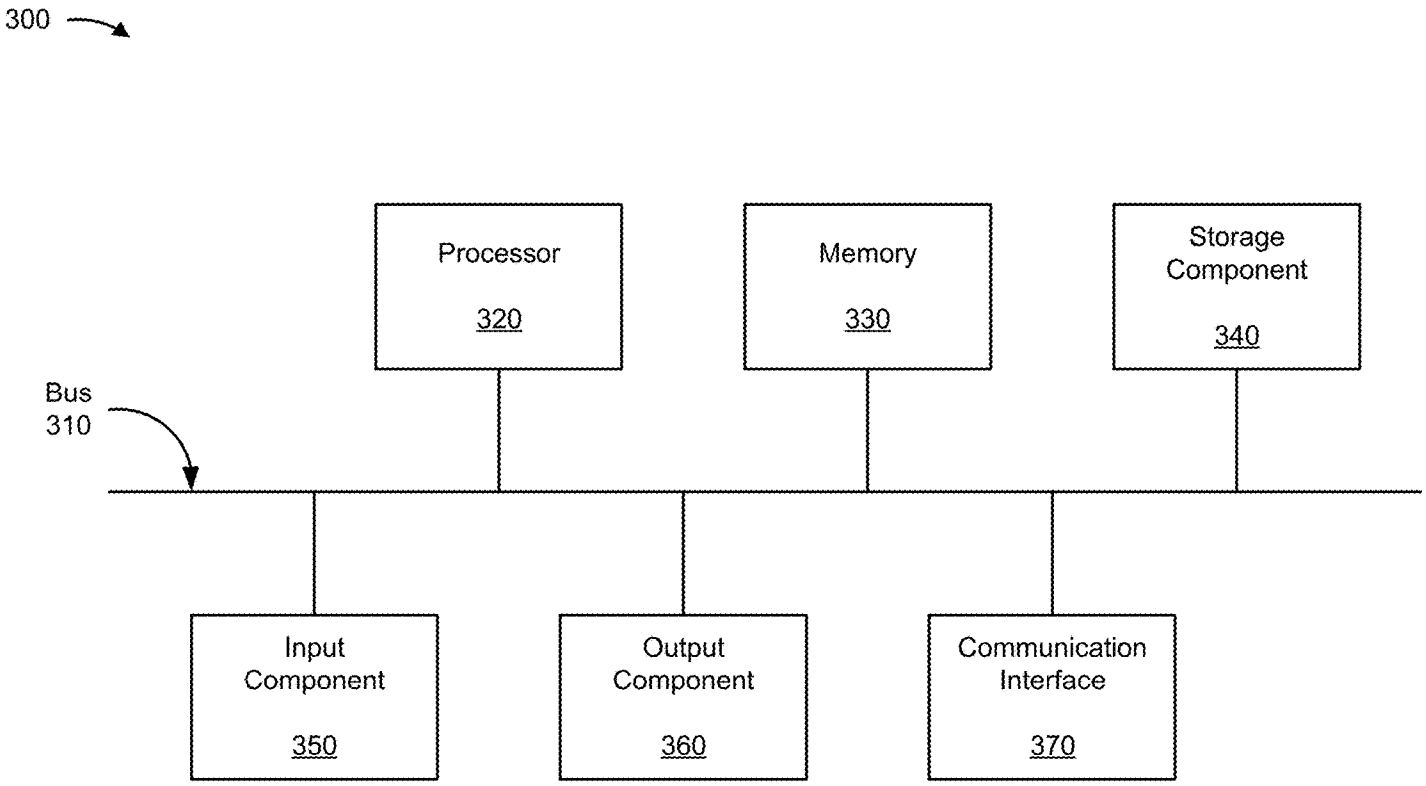
FIG. 3 is a diagram of example components of one or more devices of FIG. 2.

FIG. 3 is a diagram of example components of a device 300. Device 300 can correspond to vehicle 210, traffic monitoring device 220, traffic registration device 230, data collection device 240, traffic management platform 250, traffic controller 270, and/or traffic light 280. In some implementations, vehicle 210, traffic monitoring device 220, traffic registration device 230, data collection device 240, traffic management platform 250, traffic controller 270, and/or traffic light 280 can include one or more devices 300 and/or one or more components of device 300. As shown in FIG. 3, device 300 can include a bus 310, a processor 320, a memory 330, a storage component 340, an input component 350, an output component 360, and a communication interface 370.

Bus 310 includes a component that permits communication among the components of device 300. Processor 320 is implemented in hardware, firmware, or a combination of hardware and software. Processor 320 includes a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component. In some implementations, processor 320 includes one or more processors capable of being programmed to perform a function. Memory 330 includes a random access memory (RAM), a read only memory (ROM), and/or another type of dynamic or static storage device (e.g., a flash memory, a magnetic memory, and/or an optical memory) that stores information and/or instructions for use by processor 320. In some implementations, memory 330 can include one or more memories.

Storage component 340 stores information and/or software related to the operation and use of device 300. For example, storage component 340 can include a hard disk (e.g., a magnetic disk, an optical disk, a magneto-optic disk, and/or a solid state disk), a compact disc (CD), a digital versatile disc (DVD), a floppy disk, a cartridge, a magnetic tape, and/or another type of non-transitory computer-readable medium, along with a corresponding drive.

Input component 350 includes a component that permits device 300 to receive information, such as via user input (e.g., a touch screen display, a keyboard, a keypad, a mouse, a button, a switch, and/or a microphone). Additionally, or alternatively, input component 350 can include a sensor for sensing information (e.g., a global positioning system (GPS) component, an accelerometer, a gyroscope, and/or an actuator). Output component 360 includes a component that provides output information from device 300 (e.g., a display, a speaker, and/or one or more light-emitting diodes (LEDs)).

Communication interface 370 includes a transceiver-like component (e.g., a transceiver and/or a separate receiver and transmitter) that enables device 300 to communicate with other devices, such as via a wired connection, a wireless connection, or a combination of wired and wireless connections. Communication interface 370 can permit device 300 to receive information from another device and/or provide information to another device. For example, communication interface 370 can include an Ethernet interface, an optical interface, a coaxial interface, an infrared interface, a radio frequency (RF) interface, a universal serial bus (USB) interface, a Wi-Fi interface, a cellular network interface, or the like.

Device 300 can perform one or more processes described herein. Device 300 can perform these processes in response to processor 320 executing software instructions stored by a non-transitory computer-readable medium, such as memory 330 and/or storage component 340. A computer-readable medium is defined herein as a non-transitory memory device. A memory device includes memory space within a single physical storage device or memory space spread across multiple physical storage devices.

Software instructions can be read into memory 330 and/or storage component 340 from another computer-readable medium or from another device via communication interface 370. When executed, software instructions stored in memory 330 and/or storage component 340 can cause processor 320 to perform one or more processes described herein. Additionally, or alternatively, hardwired circuitry can be used in place of or in combination with software instructions to perform one or more processes described herein. Thus, implementations described herein are not limited to any specific combination of hardware circuitry and software.

The number and arrangement of components shown in FIG. 3 are provided as an example. In practice, device 300 can include additional components, fewer components, different components, or differently arranged components than those shown in FIG. 3. Additionally, or alternatively, a set of components (e.g., one or more components) of device 300 can perform one or more functions described as being performed by another set of components of device 300.

Figure 4:
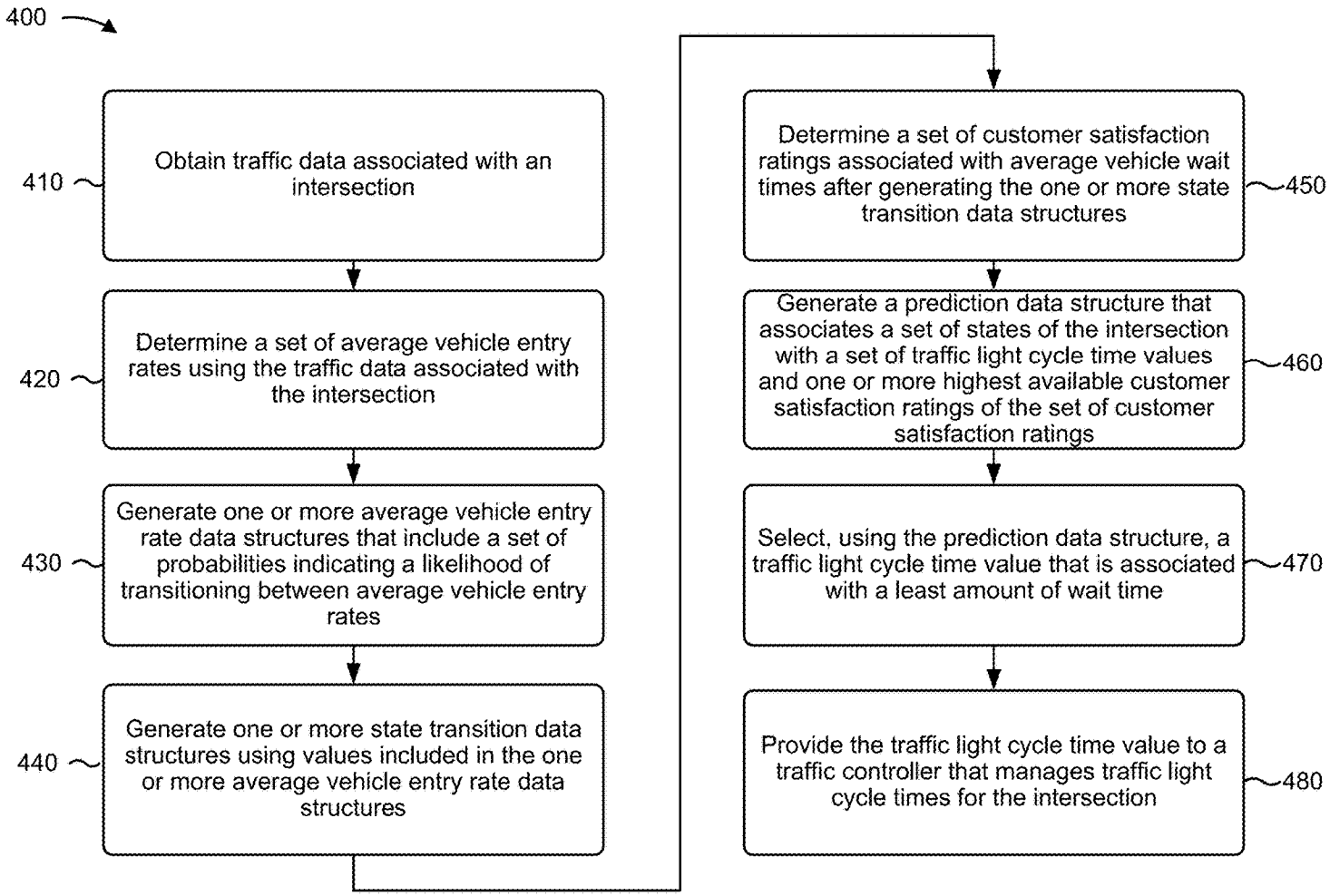
FIG. 4 is a flow chart of an example process for analyzing traffic data to select a traffic light cycle time that improves vehicle throughput at an intersection.

FIG. 4 is a flow chart of an example process 400 for analyzing traffic data to select a traffic light cycle time that improves vehicle throughput at an intersection. In some implementations, one or more process blocks of FIG. 4 can be performed by traffic management platform 250. In some implementations, one or more process blocks of FIG. 4 can be performed by another device or a group of devices separate from or including traffic management platform 250, such as vehicle 210, traffic monitoring device 220, traffic registration device 230, data collection device 240, traffic controller 270, and/or traffic light 280.

As shown in FIG. 4, process 400 can include obtaining traffic data associated with an intersection (block 410). For example, traffic management platform 250 can obtain, from data collection device 240, traffic data associated with an intersection. The traffic data can include vehicle information and/or intersection information. The vehicle information can include a vehicle identifier, information indicating a vehicle speed, information indicating a vehicle location (e.g. a set of geographic coordinates), time information (e.g., a time stamp associated with a particular vehicle entering the intersection, a time stamp associated with a particular vehicle traveling through the intersection, etc.), and/or the like. In some cases, traffic data can refer to a particular vehicle 210, a group of vehicles 210, or the like. The intersection information can include information indicating a geographic point of interest (e.g., one or more sets of geographic coordinates identifying the intersection), information indicating historical traffic light cycle times (e.g., traffic light times that have been previously implemented by traffic light 280), information indicating a number of lanes of traffic associated with the intersection, a total quantity of vehicles entering the intersection in each direction of travel during a green light, a total quantity of vehicles waiting at the intersection in each direction of travel during a red light, and/or the like. In some implementations, traffic management platform 250 can analyze the traffic data to improve vehicle throughput at the intersection, as described further herein.

In some implementations, prior to traffic management platform 250 obtaining traffic data, one or more traffic monitoring devices 220 can monitor the intersection and can report traffic data to data collection device 240. For example, traffic monitoring devices 220 can monitor a time at which vehicle 210 enters the intersection, a speed at which vehicle 210 enters the intersection, a time at which vehicle 210 travels through the intersection, a speed at which vehicle 210 travels through the intersection, a current status of a traffic light (e.g., red for a first direction, green for a second direction), and/or the like. In this way, traffic monitoring devices 220 can monitor and report traffic data for the intersection.

In some implementations, traffic management platform 250 can obtain traffic data for a baseline time period, and can store the traffic data based on time information included in the traffic data. For example, traffic management platform 250 can obtain traffic data for a baseline time period (e.g., a month, three months, a year, etc.), and can store the traffic data based on time intervals (e.g., a time interval of thirty seconds, a time interval of five minutes, a time interval of thirty minutes, etc.). As an example, if a particular time interval is set to thirty seconds, and ten vehicles 210 pass through the intersection between 7:00:00 AM and 7:00:30 AM, traffic management platform 250 can store traffic data associated with the ten vehicles 210 that pass through the intersection during the time interval. Additionally, traffic management platform 250 can store traffic data for vehicles 210 that pass through the intersection during the same time interval but on different days throughout the baseline time period. In this way, traffic management platform 250 can obtain and analyze traffic data associated with thousands, tens of thousands, millions, even billions of vehicles 210.

By receiving traffic data associated with an intersection, traffic management platform 250 can analyze the traffic data to determine a traffic light cycle time that improves vehicle throughput at the intersection and overall traffic flow.

As further shown in FIG. 4, process 400 can include determining a set of average vehicle entry rates using the traffic data associated with the intersection (block 420). For example, traffic management platform 250 can determine a set of average vehicle entry rates by analyzing the traffic data. The set of average vehicle entry rates can identify average rates at which vehicles 210 enter the intersection during particular time intervals. Additionally, traffic management platform 250 can determine a set of average vehicle throughput rates, which can identify average rates at which vehicles 210 travel through the intersection. The average vehicle throughput rates can be used to determine average vehicle wait times, as described further herein.

In some implementations, traffic management platform 250 can analyze the traffic data to determine a set of average vehicle entry rates. For example, traffic management platform 250 can analyze time information (e.g., time stamps) included in the traffic data to determine an average number of vehicles 210 entering the intersection during a particular time interval. As an example, traffic management platform 250 can determine a total number of vehicles 210 passing through the intersection between 7:00:00 AM and 7:00:00: 30 AM during one or more days of a baseline time period, and can divide the total number of vehicles 210 by a total number of days in the baseline time period to determine the average vehicle entry rate for the time interval.

In some implementations, traffic management platform 250 can analyze traffic data during particular time intervals. For example, traffic management platform 250 can obtain traffic data during a baseline time period (e.g., a month, three months, a year, etc.), and can analyze the traffic data to determine average vehicle entry rates for particular time intervals. As an example, if a particular time interval is set to ten minutes, traffic management platform 250 can determine an average vehicle entry rate for the ten minute time interval by analyzing all traffic data with time stamp values occurring during the ten minute time interval. Additionally, traffic management platform 250 can distinguish between time intervals occurring on weekdays and time intervals occurring on weekends, thereby improving the relevancy of the average vehicle entry rates.

In this way, traffic management platform 250 can use the average vehicle entry rates to predict a number of vehicles 210 that might travel through the intersection during a given time period, as described further herein.

As further shown in FIG. 4, process 400 can include generating one or more average vehicle entry rate data structures that include a set of probabilities indicating a likelihood of transitioning between average vehicle entry rates (block 430). For example, traffic management platform 250 can generate one or more average vehicle entry rate data structures as part of a Markov decision process (MDP) that can be used to predict traffic flow.

In some implementations, the MDP can define states, actions, transition probabilities, and customer satisfaction ratings. A state can include one or more parameters that define characteristics of the intersection for a particular time interval. For example, a state can be represented by one or more state parameters, such as by an average vehicle entry rate for a first direction (e.g., including north-south and south-north), an average vehicle entry rate for a second direction (e.g., including east-west and west-east), a traffic light cycle time associated with the first direction and/or the second direction, and/or the like. An action can be a recommendation that the traffic management platform can provide to a traffic controller, such as a recommendation of a traffic light cycle time for a particular direction (i.e., a time in which a traffic light can remain red or green). A transition probability can indicate a likelihood of transitioning from a first state to a second state (e.g., and can be represented by a transition value). A customer satisfaction rating can be a metric used to select actions (e.g., traffic light cycle times) that improve vehicle throughput at the intersection. For example, a customer satisfaction rating can be associated with an average vehicle wait time (e.g., a lower average vehicle wait time can be associated with a higher customer satisfaction rating).

In some implementations, as part of the MDP, traffic management platform 250 can generate an average vehicle entry rate data structure for a first direction and an average vehicle entry rate data structure for a second direction. For example, traffic management platform 250 can generate an average vehicle entry rate data structure for the first direction and an average vehicle entry rate data structure for the second direction, and the data structures can include a set of probabilities indicating a likelihood of transitioning between average vehicle entry rates.

In some implementations, traffic management platform 250 can determine a set of probabilities for the data structures by analyzing the traffic data. For example, assume traffic management platform 250 determines average vehicle entry rate values for a set of time intervals. In this case, traffic management platform 250 can, for a first average vehicle entry rate, determine a probability of a second average vehicle entry rate being a particular value by analyzing the average vehicle entry rates associated with a set of time intervals. As an example, assume there are ten time intervals and that traffic management platform 250 determines average vehicle entry rates of 0.1 for five of the time intervals and average vehicle entry rates of 0.2 for the other five time intervals. In this case, if a first average vehicle entry rate is 0.1, the probability of transitioning to a second average vehicle entry rate of 0.2 is 50% (i.e., because five of the ten average vehicle entry rates are 0.2).

By generating average vehicle entry rate data structures for the intersection, traffic management platform 250 establishes a framework that can be used to predict traffic flow.

As further shown in FIG. 4, process 400 can include generating one or more state transition data structures using values included in the one or more average vehicle entry rate data structures (block 440). For example, traffic management platform 250 can, as part of the MDP, use values included in the one or more average vehicle entry rate data structures to generate one or more state transition data structures that identify a set of probabilities indicating a likelihood of transitioning between states at the intersection. A state can include an average vehicle entry rate for a first direction, an average vehicle entry rate for a second direction, a traffic light cycle time for the first direction and/or the second direction, and/or the like.

In some implementations, traffic management platform 250 can generate a state transition data structure that includes a set of probabilities indicating a likelihood of transitioning from a first state to a second state. The first state can include a first average vehicle entry rate associated with a first direction, a first average vehicle entry rate associated with a second direction, and a traffic light cycle time associated with the first direction (e.g., a red light time). The second state can include a second average vehicle entry rate associated with the first direction, a second average vehicle entry rate associated with the second direction, and a traffic light cycle time associated with the first direction. In some implementations, traffic management platform 250 can swap the values of the average vehicle entry rates (e.g., a first average vehicle entry rate can be stored before the second average vehicle entry rate in the first state, and stored after the second average vehicle entry rate in the second state).

In some implementations, traffic management platform 250 can generate a state transition data structure without consideration of traffic light cycle times. For example, assume that a traffic light cycle time has a marginal effect on a state transition (e.g., if the intersection is saturated, slight changes to a traffic light cycle time will have little impact on traffic at the intersection). In this case, traffic management platform 250 can generate a state transition data structure that includes average vehicle entry rates for the intersection but that does not include traffic light cycle times. In this way, traffic management platform 250 conserves processing resources relative to generating a state transition data structure that includes traffic light cycle times.

In some implementations, traffic management platform 250 can determine probabilities indicating a likelihood of transitioning between states. For example, traffic management platform 250 can determine a probability of transitioning between a first state and a second state. The first state can include a first average vehicle entry rate associated with a first direction and a first average vehicle entry rate associated with a second direction. The second state can include a second average vehicle entry rate associated with the first direction and a second average vehicle entry rate associated with the second direction. In this case, traffic management platform 250 can determine a first probability of transitioning from the first average vehicle entry rate associated with the first direction to the second average vehicle entry rate associated with the first direction, and can determine a second probability of transitioning from the first average vehicle entry rate associated with the second direction to the second average vehicle entry rate associated with the second direction. Additionally, traffic management platform 250 can multiply the first probability and the second probability to determine the probability of transitioning from the first state to the second state.

Additionally, traffic management platform 250 can generate state transition data structures for a set of actions (e.g., traffic light cycle times). For example, assume a traffic light for a first direction is displaying a red light. In this case, traffic management platform 250 can consider a set of green light cycle times as possible actions to recommend to traffic controller 270. To determine an optimal action, traffic management platform 250 can generate a state transition data structure for each possible action (e.g., each green light cycle time). As an example, if a traffic light has a maximum traffic light cycle time of 30 seconds, traffic management platform can generate 30 state transition data structures (e.g., one per possible action or green light time).

By generating a set of data structures that include a set of probabilities indicating a likelihood of transitioning from a first state to a second state, traffic management platform 250 establishes a framework that can be used to predict traffic flow at the intersection.

As further shown in FIG. 4, process 400 can include determining a set of customer satisfaction ratings associated with average vehicle wait times after generating the one or more state transition data structures (block 450). For example, traffic management platform 250 can, as part of the MDP, apply a wait time function to analyze the one or more state transition data structures to determine an average vehicle wait time for each state of the intersection. In this case, traffic management platform 250 can use the average vehicle wait times to determine corresponding customer satisfaction ratings. Average vehicle wait time can refer to an average amount of time that a vehicle spends waiting at the intersection (e.g., waiting during a red light). In some implementations, a higher customer satisfaction rating can be associated with a lower average vehicle wait time, and a lower customer satisfaction rating can be associated with a higher average vehicle wait time. In some implementations, traffic management platform 250 can use the time information associated with when vehicle 210 enters the intersection and the time information associated with when vehicle 210 travels through the intersection to determine a vehicle wait time.

In some implementations, traffic management platform 250 can determine an average vehicle wait time. For example, traffic management platform 250 can execute a wait time function to determine an average vehicle wait time for a particular state that is associated with a particular action. As an example, traffic management platform 250 can determine an average vehicle wait time using the following formula:

$$d = \frac{c\left(1-\frac{g}{c}\right)^2}{2[1-(g/c)^x]} + \frac{x^2}{2\lambda(1-x)}\ 0.65\left(\frac{c}{\lambda^2}\right)^{\frac{1}{3}} x^{2+5\left(\frac{g}{c}\right)} \tag{1}$$

In equation 1, the variable d can represent an average vehicle wait time (e.g., in seconds), the variable c can represent a cycle length (e.g., in seconds), the variable g can represent a green light time (e.g., in seconds), the variable x can represent a degree of saturation (e.g., a flow to capacity ratio, such as a ratio that divides an average vehicle entry rate by an average vehicle throughput rate), and the variable λ can represent an average vehicle entry rate. In this case, the first expression $$\left(\frac{c\left(1-\frac{g}{c}\right)^2}{2[1-(g/c)^x]}\right)$$

assumes that traffic is arriving at a uniform rate, while the second expression $$\left(\frac{x^2}{2\lambda(1-x)}\right)$$

accounts for a random quantity of arriving vehicles 210. The third expression $$\left(0.65\left(\frac{c}{\lambda^2}\right)^{\frac{1}{3}} x^{2+5\left(\frac{g}{c}\right)}\right)$$

is a corrective term to adjust the initial estimate.

In some implementations, traffic management platform 250 can determine a set of customer satisfaction ratings based on determining the set of values indicating average vehicle wait times. For example, traffic management platform 250 can determine a customer satisfaction rating by comparing an average vehicle wait time and a threshold range of wait time values that are associated with customer satisfaction ratings. As an example, assume traffic management platform 250 uses a threshold range of values associated with customer satisfaction ratings that assign a score of five points to an average vehicle wait time under fifteen seconds, three points to an average vehicle wait time between fifteen seconds and thirty seconds, and zero points to an average vehicle wait time between thirty seconds and forty-five seconds. In this case, traffic management platform 250 can determine an average vehicle wait time for a particular state, and can compare the average vehicle wait time and the threshold range of customer satisfaction ratings to determine a customer satisfaction rating for the particular state.

In this way, traffic management platform 250 associates states with customer satisfaction ratings, thereby allowing traffic management platform 250 to identify states with low average vehicle wait times (and high customer satisfaction ratings) as candidate states to recommend to traffic controller 270.

As further shown in FIG. 4, process 400 can include generating a prediction data structure that associates a set of states of the intersection with a set of traffic light cycle time values and one or more highest customer satisfaction ratings of the set of customer satisfaction ratings (block 460). For example, traffic management platform 250 can generate a prediction data structure that associates a set of states of the intersection with a set of traffic light cycle time values that are associated with a subset of the set of customer satisfaction ratings that identify the one or more highest customer satisfaction ratings. A highest customer satisfaction rating can refer to a customer satisfaction rating for a particular state that is higher than all other customer satisfaction ratings for that particular state.

In some implementations, traffic management platform 250 can generate a prediction data structure that associates a state with traffic light cycle time value and a highest customer satisfaction rating. For example, traffic management platform 250 can execute a recursive function to identify a highest customer satisfaction rating for each state, and can store the associated values in the prediction data structure. As an example, traffic management platform 250 can determine a highest customer satisfaction rating using the following formula:

$$V(s) = \max_{a} \sum_{s'} T(s, a, s')[R(s, a, s') + \gamma V(s')] \tag{2}$$

In equation 2, the variable V* (s) can represent a highest customer satisfaction rating for state s, a can represent an action (e.g., a recommendation of a particular traffic light cycle time), T can represent a transition table (e.g., where s is an initial state, a is a particular traffic light cycle time, and s' is the next state), and y can represent a customer satisfaction rating function. In this case, traffic management platform 250 can determine, using equation 2 and for each state, an action that is associated with a highest customer satisfaction rating. Alternatively, traffic management platform 250 can execute a different function to determine a highest customer satisfaction rating, such as an iterative function.

By generating a prediction data structure that associates states, customer satisfaction ratings, and/or traffic light cycle times, traffic management platform 250 is able to receive current traffic data, and can use the prediction data structure to select an action (e.g., a particular traffic light cycle time value) that can improve vehicle throughput at the intersection.

As further shown in FIG. 4, process 400 can include selecting, using the prediction data structure, a traffic light cycle time value that is associated with a least amount of vehicle wait time (block 470). For example, traffic management platform 250 can obtain additional traffic data associated with a current state of the intersection, can analyze the additional traffic data to determine a current average vehicle entry rate, and can select a traffic light cycle time value (i.e., an action that traffic controller 270 can implement to improve vehicle throughput at the intersection) associated with a least amount of vehicle wait time.

In some implementations, traffic management platform 250 can select a traffic light cycle time value associated with a least amount of vehicle wait time. For example, traffic management platform 250 can compare a current state value (e.g., a current average vehicle entry rate value) and a set of state values included in the prediction data structure. In this case, traffic management platform 250 can identify a state value of the set of state values that satisfies a threshold level of similarity with the current state value. Here, traffic management platform 250 can select a traffic light cycle time value that is associated with the identified state value and a highest customer satisfaction rating value.

In this way, traffic management platform 250 can select an action that reduces vehicle wait time (e.g., relative to not updating the traffic light cycle time), thereby improving vehicle throughput at the intersection.

As further shown in FIG. 4, process 400 can include providing the traffic light cycle time value to a traffic controller that manages traffic light cycle times for the intersection (block 480). For example, traffic management platform 250 can provide the traffic light cycle time value to traffic controller 270, which can instruction traffic light 280 to implement the traffic light cycle time at the intersection. By providing traffic light 280 with a traffic light cycle time associated with a least amount of vehicle wait time, traffic management platform 250 improves vehicle throughput at the intersection.

In some implementations, traffic management platform 250 can receive feedback information indicating whether the traffic light cycle time improved vehicle throughput at the intersection. For example, traffic management platform 250 can receive, from traffic controller 270, feedback information indicating a vehicle entry rate for the intersection while implementing recommended traffic light cycle time values. In this case, traffic management platform 250 can compare the feedback information and an average vehicle throughput rate to determine whether the traffic light cycle time value improved vehicle throughput at the intersection.

In some implementations, traffic management platform 250 can apply a machine learning technique and/or an artificial intelligence technique to determine feedback trends. For example, traffic management platform 250 can receive feedback information for a particular time interval throughout the course of a feedback testing period (e.g., a month, three months, etc.). In this case, traffic management platform 250 can apply a machine learning technique and/or an artificial intelligence technique to identify one or more feedback trends. A feedback trend may identify time intervals where traffic management platform 250 is likely to improve vehicle throughput at the intersection and time intervals where traffic management platform 250 is unlikely to improve vehicle throughput at the intersection. As an example, a feedback trend may identify that traffic management platform 250 may be unable to improve vehicle throughput at the intersection during periods where traffic is unpredictable (e.g., rush hour). In this case, traffic management platform 250 provide traffic light cycle times to traffic controller 270 only if a feedback trend indicates a likelihood of the traffic light cycle time improving vehicle throughput at the intersection.

In this way, traffic management platform 250 conserves processing resources relative to predicting traffic flow without utilizing a machine learning technique and/or an artificial intelligence technique.

Although FIG. 4 shows example blocks of process 400, in some implementations, process 400 can include additional blocks, fewer blocks, different blocks, or differently arranged blocks than those depicted in FIG. 4. Additionally, or alternatively, two or more of the blocks of process 400 can be performed in parallel.

In this way, traffic management platform 250 can recommend a traffic light cycle time that reduces vehicle wait time, thereby improving vehicle throughput at the intersection. By predicting traffic flow using an MDP, traffic management platform 250 conserves processing resources relative to predicting traffic flow using a standard machine learning technique (e.g., a technique that uses historical data to train a model).

The foregoing disclosure provides illustration and description, but is not intended to be exhaustive or to limit the implementations to the precise form disclosed. Modifications and variations are possible in light of the above disclosure or can be acquired from practice of the implementations.

As used herein, the term component is intended to be broadly construed as hardware, firmware, or a combination of hardware and software.

Some implementations are described herein in connection with thresholds. As used herein, satisfying a threshold can refer to a value being greater than the threshold, more than the threshold, higher than the threshold, greater than or equal to the threshold, less than the threshold, fewer than the threshold, lower than the threshold, less than or equal to the threshold, equal to the threshold, etc.

To the extent the aforementioned embodiments collect, store, or employ personal information provided by individuals, it should be understood that such information shall be used in accordance with all applicable laws concerning protection of personal information. Additionally, the collection, storage, and use of such information can be subject to consent of the individual to such activity, for example, through well known "opt-in" or "opt-out" processes as can be appropriate for the situation and type of information. Storage and use of personal information can be in an appropriately secure manner reflective of the type of information, for example, through various encryption and anonymization techniques for particularly sensitive information.

It will be apparent that systems and/or methods, described herein, can be implemented in different forms of hardware, firmware, or a combination of hardware and software. The actual specialized control hardware or software code used to implement these systems and/or methods is not limiting of the implementations. Thus, the operation and behavior of the systems and/or methods were described herein without reference to specific software code—it being understood that software and hardware can be designed to implement the systems and/or methods based on the description herein.

Even though particular combinations of features are recited in the claims and/or disclosed in the specification, these combinations are not intended to limit the disclosure of possible implementations. In fact, many of these features can be combined in ways not specifically recited in the claims and/or disclosed in the specification. Although each dependent claim listed below can directly depend on only one claim, the disclosure of possible implementations includes each dependent claim in combination with every other claim in the claim set.

No element, act, or instruction used herein should be construed as critical or essential unless explicitly described as such. Also, as used herein, the articles "a" and "an" are intended to include one or more items, and can be used interchangeably with "one or more." Furthermore, as used herein, the term "set" is intended to include one or more items (e.g., related items, unrelated items, a combination of related and unrelated items, etc.), and can be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A device, comprising:

one or more memories; and one or more processors, communicatively coupled to the one or more memories, to:

determine a set of average vehicle entry rates using traffic data associated with an intersection, the set of average vehicle entry rates identifying average rates at which vehicles enter the intersection during particular time intervals;

generate one or more data structures that include a set of state values and a set of transition values indicating a likelihood of transitioning between states, the set of state values including the set of average vehicle entry rates;

determine, for the set of state values, a set of average vehicle wait time values after generating the one or more data structures, the set of average vehicle wait time values being associated with a set of customer satisfaction rating values;

generate a prediction data structure that associates the set of state values with a set of traffic light cycle time values and a subset of the set of customer satisfaction rating values, the subset of the set of customer satisfaction rating values being associated with highest customer satisfaction ratings;

determine a current state value for the intersection after generating the prediction data structure;

analyze the set of state values and the current state value to identify a state value and a traffic light cycle time value that is associated with a highest customer satisfaction rating value; and provide the traffic light cycle time value to a traffic controller that manages traffic light cycle times for the intersection.

2. The device of claim 1, where the traffic data associated with the intersection includes at least one of:

information identifying a vehicle, information indicating a vehicle speed, information indicating a vehicle location, information indicating a time stamp, information indicating a geographic point of interest, or information indicating a historical traffic light cycle time.

3. The device of claim 1, where the one or more processors, when determining the set of average vehicle entry rates, are to:

obtain the traffic data associated with the intersection, the traffic data associated with the intersection, originating from one or more of:

a traffic camera, a vehicle sensor, or an inductive loop; and analyze the traffic data associated with the intersection to determine the set of average vehicle entry rates.

4. The device of claim 1, where the one or more processors, when generating the one or more data structures, are to:

generate a first data structure of the one or more data structures that associates a first average vehicle entry rate for a first direction and a second average vehicle entry rate for the first direction using a set of values indicating a likelihood of transitioning from the first average vehicle entry rate for the first direction to the second average vehicle entry rate for the first direction; and generate a second data structure of the one or more data structures that associates a first average vehicle entry rate for a second direction and a second average vehicle entry rate for the second direction using a set of values indicating a likelihood of transitioning from the first average vehicle entry rate for the second direction to the second average vehicle entry rate for the second direction.

5. The device of claim 4, where the one or more processors, when generating the one or more data structures, are to:

analyze average vehicle entry rates included in the first data structure and average vehicle entry rates included in the second data structure to determine a set of probabilities indicating a likelihood of transitioning from a first state to a second state, the first state being associated with the first average vehicle entry rate for the first direction and the first average vehicle entry rate for the second direction, and the second state being associated with the second average vehicle entry rate for the first direction and the second average vehicle entry rate for the second direction; and generate a third data structure of the one or more data structures that associates the first state and the second state using the set of values indicating the likelihood of transitioning from the first state to the second state.

6. The device of claim 1, where the one or more processors, when generating the prediction data structure that includes the subset of the set of customer satisfaction rating values, are to:

compare a first customer satisfaction rating value and a second customer satisfaction rating value, the first customer satisfaction rating value and the second customer satisfaction rating value being included in the set of customer satisfaction rating values; and determine a highest customer satisfaction rating value based on comparing the first customer satisfaction rating value and the second customer satisfaction rating value.

7. The device of claim 1, where the one or more processors, when analyzing the set of state values and the current state value, are to:

compare the set of state values and the current state value;

determine that the state value of the set of state values satisfies a threshold level of similarity with the current state value; and identify the traffic light cycle time value that is associated with the state value that satisfies the threshold level of similarity with the current state value; and where the one or more processors, when providing the traffic light cycle time value to the traffic controller, are to:

provide the traffic light cycle time value to the traffic controller, the traffic controller to provide the traffic light cycle time value to a traffic light associated with the intersection.

8. A non-transitory computer-readable medium storing instructions, the instructions comprising:

one or more instructions that, when executed by one or more processors, cause the one or more processors to:

determine a set of average vehicle entry rates using traffic data associated with an intersection;

generate one or more data structures that include a set of state values and a set of transition values indicating a likelihood of transitioning between states, the set of state values including the set of average vehicle entry rates;

determine a set of average vehicle wait time values after generating the one or more data structures, the set of average vehicle wait time values being associated with a set of customer satisfaction rating values;

generate a prediction data structure including:

the set of state values that include the set of average vehicle entry rates, the set of customer satisfaction rating values, and a set of traffic light cycle time values;

determine a current state value after generating the prediction data structure;

analyze the set of state values and the current state value to identify a state value and a traffic light cycle time value that is associated with a highest customer satisfaction rating value; and provide the traffic light cycle time value to a traffic controller that manages traffic light cycle times for the intersection.

9. The non-transitory computer-readable medium of claim 8, where the set of state values, the set of customer satisfaction rating values, and the set of traffic light cycle time values are determined using a Markov decision process (MDP).

10. The non-transitory computer-readable medium of claim 8, where the one or more instructions, that cause the one or more processors to determine the set of average vehicle wait time values, cause the one or more processors to:

determine, using a wait time function, an average vehicle wait time value, the average vehicle wait time value being associated with a particular state value and a particular traffic light cycle time value;

compare the average vehicle wait time value and a threshold range of values associated with customer satisfaction ratings; and determine a customer satisfaction rating based on comparing the average vehicle wait time value and the threshold range of values associated with customer satisfaction ratings.

11. The non-transitory computer-readable medium of claim 8, where the one or more instructions, when executed by the one or more processors, further cause the one or more processors to:

analyze the set of average vehicle entry rates to determine a set of values indicating a likelihood of transitioning from a first state to a second state, the first state being associated with a first average vehicle entry rate for a first direction and a first average vehicle entry rate for a second direction, and the second state being associated with a second average vehicle entry rate for the first direction and a second average vehicle entry rate for the second direction; and generate a state transition data structure that associates the first state and the second state using the set of values indicating the likelihood of transitioning from the first to the second state.

12. The non-transitory computer-readable medium of claim 8, where the one or more instructions, that cause the one or more processors to generate the prediction data structure, cause the one or more processors to:

generate the prediction data structure by associating the set of state values with the set of traffic light cycle time values via the set of customer satisfaction rating values, the set of customer satisfaction rating values being associated with highest customer satisfaction ratings.

13. The non-transitory computer-readable medium of claim 8, where the one or more instructions, that cause the one or more processors to determine the current state value, cause the one or more processors to:

obtain additional traffic data associated with a current state of the intersection; and analyze the additional traffic data to determine the current state value.

14. The non-transitory computer-readable medium of claim 8, where the one or more instructions, that cause the one or more processors to analyze the set of state values and the current state value, cause the one or more processors to:

compare the set of state values included in the prediction data structure and the current state value;

identify the state value that satisfies a threshold level of similarity with the current state value; and select the traffic light cycle time value associated with the state value, the traffic light cycle time value being associated with improving vehicle throughput at the intersection.

15. A method, comprising:

determining, by a device, a set of average vehicle entry rates using traffic data associated with an intersection;

generating, by the device, one or more data structures that include a set of state values and a set of transition values indicating a likelihood of transitioning between states, the set of state values including the set of average vehicle entry rates;

determining, by the device, a set of customer satisfaction rating values associated with a set of average vehicle wait time values after generating the one or more data structures;

generating, by the device, a prediction data structure that associates the set of state values with a set of traffic light cycle time values and one or more customer satisfaction rating values of the set of customer satisfaction rating values;

determining, by the device, a current state value after generating the prediction data structure;

analyzing, by the device, the set of state values and the current state value to identify a traffic light cycle time value, the traffic light cycle time value being associated with a state value of the set of state values and a highest customer satisfaction rating value of the set of customer satisfaction rating values; and providing, by the device, the traffic light cycle time value to a traffic controller that manages traffic light cycle times for the intersection.

16. The method of claim 15, where determining the set of average vehicle entry rates comprises:

obtaining the traffic data associated with the intersection; and analyzing the traffic data associated with the intersection to determine the set of average vehicle entry rates, the set of average vehicle entry rates identifying average rates at which vehicles enter the intersection during particular time intervals.

17. The method of claim 15, where generating the one or more data structures comprises:

analyzing the set of average vehicle entry rates, the set of average vehicle entry rates including one or more average vehicle entry rates for a first direction and one or more average vehicle entry rates for a second direction;

determining a set of values indicating a likelihood of transitioning from a first state to a second state based on analyzing the set of average vehicle entry rates, the first state and the second state including:

the one or more average vehicle entry rates for the first direction, the one or more average vehicle entry rates for the second direction, and a traffic light cycle time for one or more of the first direction or the second direction; and generating a data structure of the one or more data structures that associates the first state and the second state using the set of values indicating the likelihood of transitioning from the first state to the second state.

18. The method of claim 15, where determining the set of customer satisfaction rating values comprises:

determining, using a wait time function, an average vehicle wait time value;

comparing the average vehicle wait time value and a threshold range of values associated with customer satisfaction ratings; and determining a customer satisfaction rating value based on comparing the average vehicle wait time and the threshold range of values associated with customer satisfaction ratings.

19. The method of claim 15, where determining the current state value comprises:

obtaining additional traffic data associated with a current state of the intersection; and analyzing the additional traffic data to determine a current average vehicle entry rate for the intersection.

20. The method of claim 15, where analyzing the set of state values and the current state value comprises:

comparing the set of state values and the current state value;

determining that the state value of the set of state values satisfies a threshold level of similarity with the current state value; and identifying the traffic light cycle time value that is associated with the state value that satisfies the threshold level of similarity with the current state value.

* * * * *